US006910302B2

(12) United States Patent
Crawford

(10) Patent No.: US 6,910,302 B2
(45) Date of Patent: Jun. 28, 2005

(54) DOOR HOLD OPEN AND CONTROLLED RELEASE MECHANISM

(76) Inventor: Alan Crawford, 2615 W. Victory Blvd., Apartment B, Burbank, CA (US) 91505

( * ) Notice: Subject to any disclaimer, the term of this patent is extended or adjusted under 35 U.S.C. 154(b) by 40 days.

(21) Appl. No.: 09/950,504

(22) Filed: Sep. 13, 2001

(65) Prior Publication Data

US 2003/0046869 A1 Mar. 13, 2003

(51) Int. Cl.[7] ..... E05F 1/00

(52) U.S. Cl. ..... 49/379; 49/67; 49/103; 16/49

(58) Field of Search ..... 49/379, 364, 137, 49/272, 273, 263, 63, 67, 103, 114; 16/49, 71, DIG. 17

(56) References Cited

U.S. PATENT DOCUMENTS

| | | | | |
|---|---|---|---|---|
| 2,965,918 A | * | 12/1960 | Leanza | 16/82 |
| 4,194,264 A | | 3/1980 | Stoffregen | |
| 4,506,407 A | | 3/1985 | Downey | |
| 4,536,916 A | | 8/1985 | Storandt et al. | |
| 4,803,754 A | | 2/1989 | Roberts | |
| 4,815,163 A | | 3/1989 | Simmons | |
| 4,878,265 A | | 11/1989 | Nesbitt | |
| 4,894,883 A | | 1/1990 | Fleischhauer | |
| 5,048,150 A | | 9/1991 | Guerin | |
| 5,083,342 A | | 1/1992 | Klinefelter | |
| 5,131,115 A | | 7/1992 | Sarto | |
| 5,293,666 A | | 3/1994 | Armstrong | |
| 5,311,642 A | | 5/1994 | Tillman et al. | |
| 5,592,780 A | * | 1/1997 | Checkovich | 49/386 |
| 5,630,248 A | * | 5/1997 | Luca | 16/71 |
| 5,855,039 A | * | 1/1999 | Crawford | 16/49 |
| 5,944,399 A | * | 8/1999 | Gillispie | 312/324 |
| 6,125,505 A | | 10/2000 | Jensen et al. | |
| 6,138,412 A | | 10/2000 | Rieckmann et al. | |
| 6,151,753 A | | 11/2000 | Salutzki | |
| 6,154,924 A | | 12/2000 | Woo | |
| 6,178,698 B1 | | 1/2001 | Benson et al. | |
| 6,205,615 B1 | | 3/2001 | Jensen et al. | |
| 6,240,598 B1 | | 6/2001 | Moore | |
| 6,449,904 B1 | * | 9/2002 | Paasonen | 49/103 |
| 6,564,510 B2 | * | 5/2003 | Juntunen et al. | 49/103 |

* cited by examiner

*Primary Examiner*—Gregory J. Strimbu

(57) ABSTRACT

A door hold open and controlled release mechanism is designed for usage in a doorway system having an inner door, an outer door and a door closer. It includes a catch mechanism and a catch release mechanism. The catch mechanism holds the outer door, typically a screen door or storm door, in an open position against the closing tendency of the door closer. Movement of the inner door to an open position then toward a closed position triggers the catch release mechanism which allows the outer door to close under the urging of the door closer.

15 Claims, 4 Drawing Sheets

DOOR HOLD OPEN AND CONTROLLED RELEASE MECHANISM

BACKGROUND OF THE INVENTION

1. Field of the Invention

This invention relates to a door closer mechanism adapted for usage in conjunction with a first door mounted in juxtaposition with a second door such as a screen door mounted with an entry door of an edifice or house. More specifically, the present invention relates to a door hold open and controlled release mechanism for use with a two-door arrangement, the mechanism comprising a catch mechanism for holding the first door open and a catch release mechanism for closing the first door upon the closing of the second door.

2. Description of the Related Art

Door closers sold for use with screen doors or storm doors are typically in the form of a cylinder with an axially extendable rod, which is biased toward retracting by an internal coil spring and damped pneumatically or hydraulically. In order to hold the door in an open position a manual latching feature is generally provided in the form of a tab through which the rod extends. The tab prevents retraction of the rod because the cylinder end contacts it off center creating a leveraged frictional force on the rod sufficient to counter the bias spring.

In order to hold the door open, the user must restrain the door from closing while reaching up and moving the tab along the rod to the base of the cylinder. In order to release the door, the user must hold it open a bit further to free the tab so it may be moved to the free end of the rod.

These operations are cumbersome and inconvenient and especially so when carrying packages.

There has been no simple, inexpensive and convenient way to hold open and close a screen or storm door before the invention disclosed in U.S. Pat. No. 5,855,039 (Delay Door Closer to Crawford). This device holds a first door once it has been opened to a certain position then allows it to close when the second door is opened past a set point. This invention however was limited to having the second door release the first door upon the opening of the second door.

SUMMARY OF THE INVENTION

In one embodiment, the present invention relates to a door hold open and controlled release mechanism adapted for usage in conjunction with a first door mounted in juxtaposition with a second door, the first door being biased toward a closed position. The mechanism comprises a first means for holding the first door in an open position against the first door's tendency to move toward the closed position; and a second means for disengaging the first means upon closing of the second door, thereby allowing the first door to move toward its closed position.

In another embodiment, the first means of the mechanism of the present invention comprises a catch mechanism; the catch mechanism comprising a catch member and a caught member. For purposes of the invention, the term "catch member" is defined as that portion of a dual part catch mechanism which is more closely associated with the second door and "caught member" is defined as that portion of a dual part catch mechanism more closely associated with the first door. In still another embodiment, the caught member comprises a rod, the rod being connected to the first door and engaging with the catch member to hold the first door in the open position. For the purposes of the invention the word "rod" includes appropriate meanings of the word "shaft". In yet another embodiment, the second means comprises a catch release mechanism; the catch release mechanism comprising an activator coupled to a disengaging device. In still yet another embodiment, the activator comprises a follower, the follower being biased against the second door and positioned to be in contact with the second door during a portion of the second door's movement so that during this period of contact as the second door moves the follower moves correspondingly.

In a further embodiment, the disengaging device causes disengagement of the first means for holding the first door open as the follower moves corresponding to the second door's closing movement. In still a further embodiment, the present invention relates to a door hold open and controlled release system comprising: a door arrangement comprising a first door mounted in juxtaposition with a second door, the first door being movable between a first open position and a first closed position, the first door having a biasing device exerting a biasing force against the first door tending to move the first door from the first open position to the first closed position and to maintain the first door in the first closed position, the second door being movable between a second open position and a second closed position; a catch mechanism connected to the first door, the catch mechanism being designed to hold the first door in the first open position; and a catch release mechanism connected to the catch mechanism, the catch release mechanism causing disengagement of the catch mechanism upon the second door being moved from the second open position toward the second closed position thereby allowing the biasing device to move the first door from the first open position toward the first closed position.

In another embodiment, the catch mechanism comprises a rod and a catch member, the rod being connected to the first door, the rod engaging with the catch member to hold the first door in the open position. In yet another embodiment, the catch release mechanism comprises an activator and a disengaging device, the activator being coupled to the disengagement device in such a way that closing movement of the second door moves the activator causing the disengaging device to prevent the catch mechanism from holding the first door in the open position thereby allowing the biasing force to close the first door.

In still yet another embodiment, the system further comprises a door frame and a housing mounted to the door frame, the catch mechanism and the catch release mechanism being mounted on the housing. In a further embodiment, the location of said first open position is adjustable, by means of changing the mounted orientation of the housing.

In still a further embodiment, the present invention also relates to a door hold open and controlled release mechanism adapted for usage in conjunction with a door, a door frame, and a door closer, the mechanism comprising: a housing adapted to be mounted to the door frame and adapted to be connected to the door closer; a catch member connected to the housing and adapted to engage the door closer in a manner whereby the catch member allows free movement of the door as the door is being opened but once the door has passed a set point, the catch member restrains the door with sufficient force to resist the closing tendency of the door closer; and a catch release mechanism connected to the housing which when deflected in one direction causes the catch mechanism to release the door to thereby allow the door to move toward a closed position. In another further embodiment, the door closer comprises a rod and a biasing spring, and the catch member is adapted to engage the door closer rod.

In yet another further embodiment, the catch member comprises a first ramp section, a hold section and a biasing element arranged in a manner whereby as the door is opened, the door closer rod contacts the first ramp section causing deflection of the catch member in a direction counter to the bias of the biasing element and upon continued movement of the door, the door closer rod passes the first ramp section and is held in the hold section by the biasing element.

In another embodiment, the catch member further comprises a second ramp section and the catch release mechanism further comprises a wedge, the second ramp section and the wedge being arranged such that when the catch release mechanism is moved the wedge engages the second ramp section thereby causing deflection of the catch member thus allowing release of the door closer rod from the hold section of the catch member. In yet another embodiment, the catch release mechanism further comprises a joint and a stop wherein the joint is biased toward a stopped position, so that as the catch release mechanism is moved in one direction the joint flexes and the catch release mechanism does not engage the catch second ramp but as it is moved in an opposing direction it is prevented from flexing by its stop and does cause the wedge to engage the catch second ramp allowing release of the door closer rod. In another embodiment the point at which the catch member restrains the door is adjustable by means of changing the mounted orientation of the housing.

In a further embodiment, the present invention relates to a method of manufacturing a door hold open and controlled release mechanism, the mechanism being adapted for usage in conjunction with a first door mounted in juxtaposition with a second door, the method comprising: provision of a first means for holding the first door in an open position against a biasing force tending to move the first door toward a closed position; and provision of a second means for disengaging the first means upon closing of the second door, thereby allowing the first door to be moved by said biasing force toward a closed position.

In another further embodiment, the first means comprises a catch mechanism, the catch mechanism comprising a catch member and a caught member, and the method further comprises connecting the caught member to the first door, and allowing the catch member to engage with the caught member to hold the first door in the open position, the second means comprises a catch release mechanism, the catch release mechanism comprising an activator and a disengaging device, and the method further comprises coupling the activator to the disengagement device such that when the second door moves the activator, the disengaging device disengages the catch mechanism thereby allowing the biasing force to close the first door. In still another further embodiment, the caught member comprises a rod and the activator comprises a follower adapted to follow the movement of the second door.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
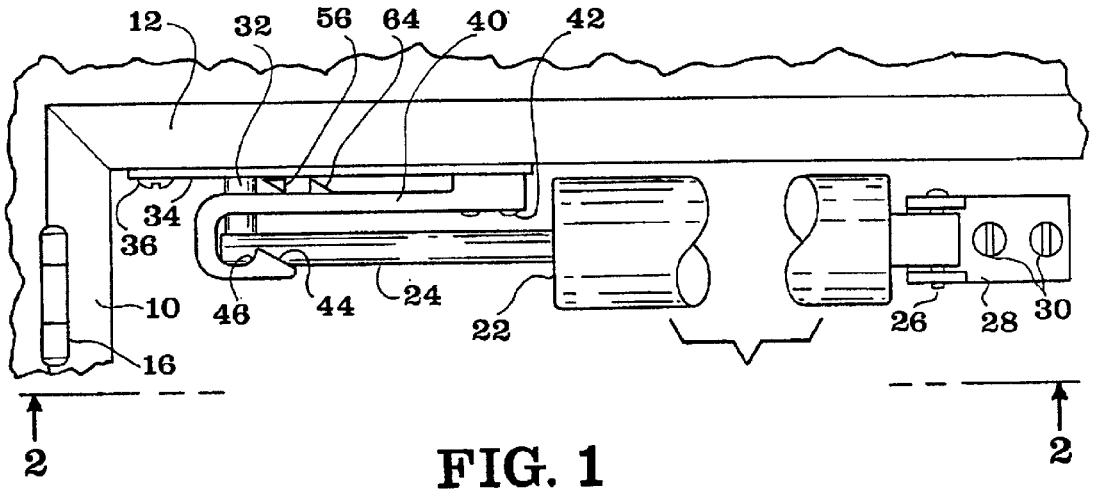
FIG. 1 is a side view of the left top corner of a doorway looking in from the outside showing the mechanism of the present invention with inner and outer doors in a closed position (the inner and outer doors are omitted in this view for clarity)

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessary to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Referring to FIGS. 1–4, a portion of a conventional doorway is shown including a portion of the hinge-side door jamb 10, an adjacent portion of the lintel 12, a portion of an outer door 14, which could be a screen door or a storm door, an outer door hinge 16, a portion of an inner door 18, which would typically be the main door, and an inner door hinge 20.

A conventional door closer is shown consisting of a cylinder 22 and an axially moveable rod 24. Internal to cylinder 22 is a piston (not shown), which is connected to rod 24, a compression spring (not shown) which biases rod 24 toward its retracted position and a fluid (also not shown)—either air or oil—which provides damping. Cylinder 22 is pivotally attached to outer door 14 by means of pivot pin 26, bracket 28 and screws 30. Rod 24 is pivotally attached to lintel 12 by means of pivot 32, housing plate 34, screws 36 and screw 38.

Figure 2:
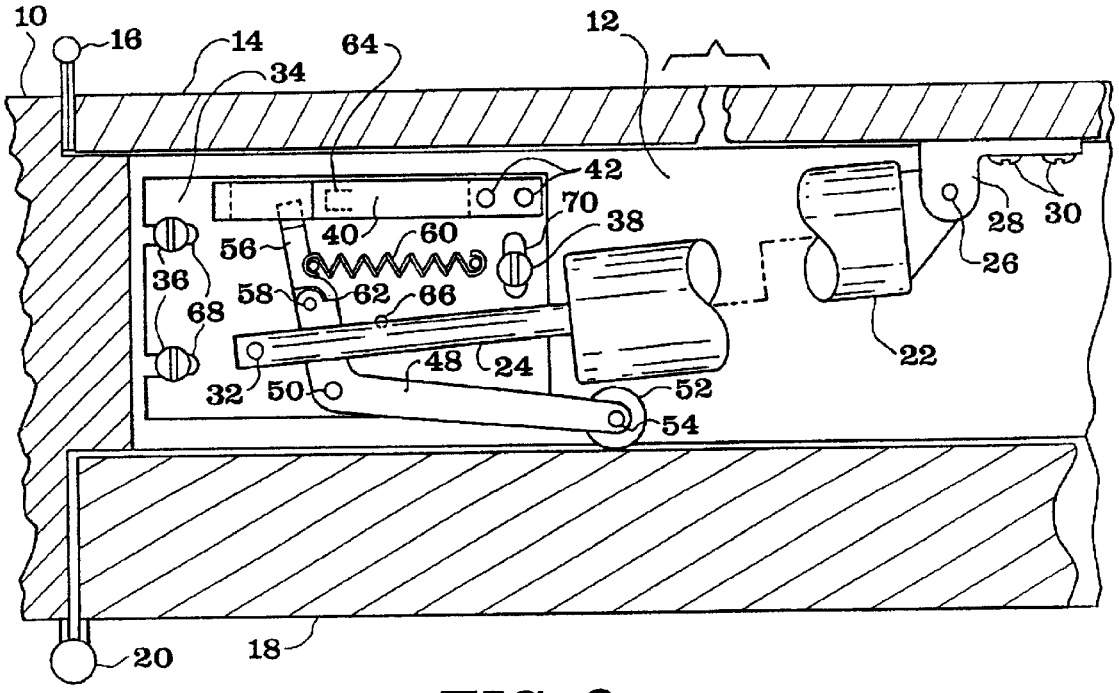
FIG. 2 is an underside sectional view taken along line 2—2 of FIG. 1.
Figures 3, 4:
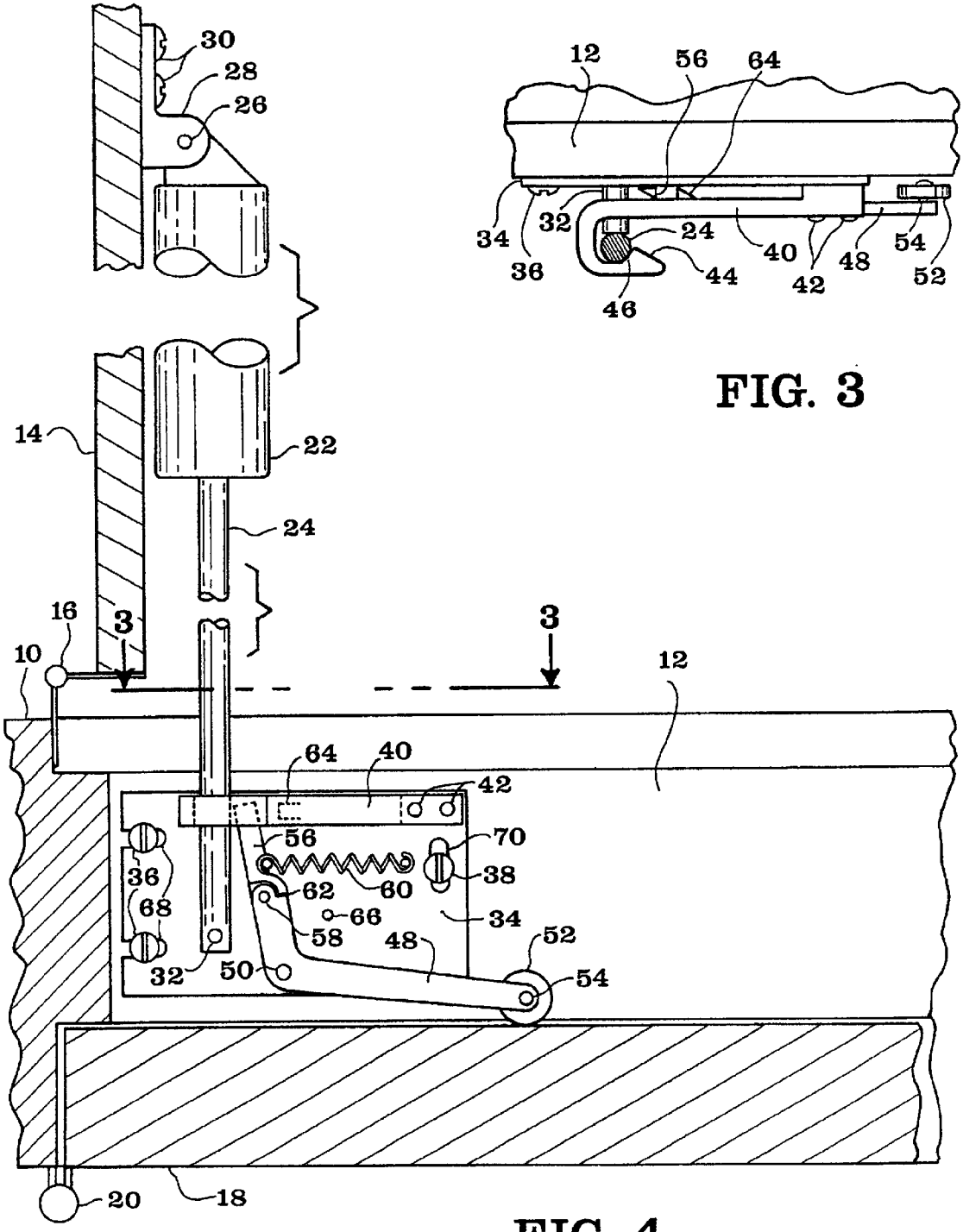
FIG. 3 is a side view showing the mechanism of the present invention as shown in FIG. 1 except that the outer door is in an open position.
FIG. 4 is an underside view to FIG. 3 showing the mechanism of the present invention with the outer door open.

A catch 40 is rigidly mounted at one end to plate 34 by rivets 42. Catch 40, if designed as shown, would be molded of a flexible yet durable material such as an acetyl or nylon plastic. The free end of catch 40 has a ramp 44 and a hold section 46. The portion of catch 40 between the hold section 46 and the rivets 42 comprises a biasing element that has resilient flexible characteristics. As the outer door 14 opens rod 24 rotates about its pivot 32 in a counter clockwise direction in FIG. 2. As outer door 14 approaches a fully open position rod 24 contacts ramp 44 and deflects the free end of catch 40 downward as seen in FIG. 1. Since the catch 40 is made of a resiliently flexible material and the angle of the ramp 44 is shallow this does not materially impede the movement of the outer door 14. Once the outer door 14 has opened approximately 90 degrees from its closed position the rod 24 has passed the ramp section 44 and reached the hold section 46. At that point catch 40 will spring back to its original shape as shown in FIG. 3 due to the biasing element portion thereof. Now if the outer door 14 is released it will not close on its own since the force required to rotate rod 24 back out of the hold section 46 is greater than that applied by the door closer cylinder 22. However, if additional force is applied to outer door 14 in the direction of closing then the hold function of catch 40 can be overridden without damaging any part of the mechanism.

A release lever 48 is pivotally mounted to housing plate 34 by means of pivot 50. Wheel 52 is attached to release lever 48 by means of axle 54. A wedge member 56 is pivotally attached to release lever 48 at pivot point 58. Extension spring 60 biases wedge member 56 and release lever 48. In FIG. 2, the release lever 48 is prevented from rotating under the influence of spring 60 by contact of wheel 58 with the inner door 18. Wedge member 56 is prevented from rotating at pivot point 58 by stop 62.

Figure 5:
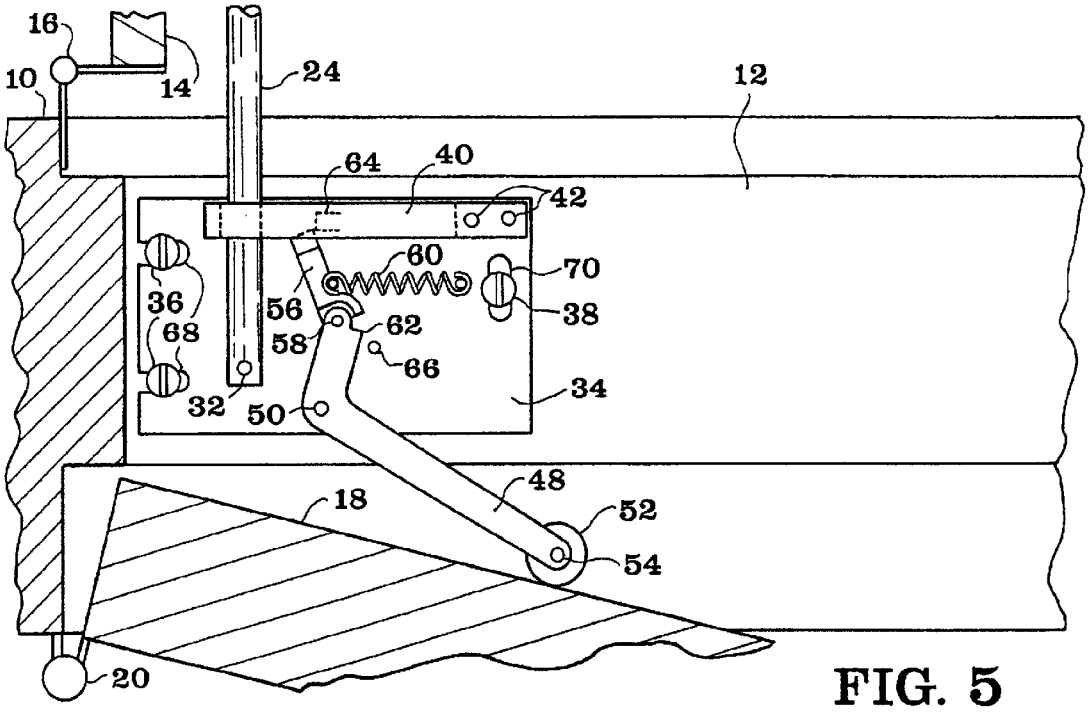
FIG. 5 is a view similar to FIG. 2 and FIG. 4 but with the outer door open and the inner door in a partially open position.
Figure 6:
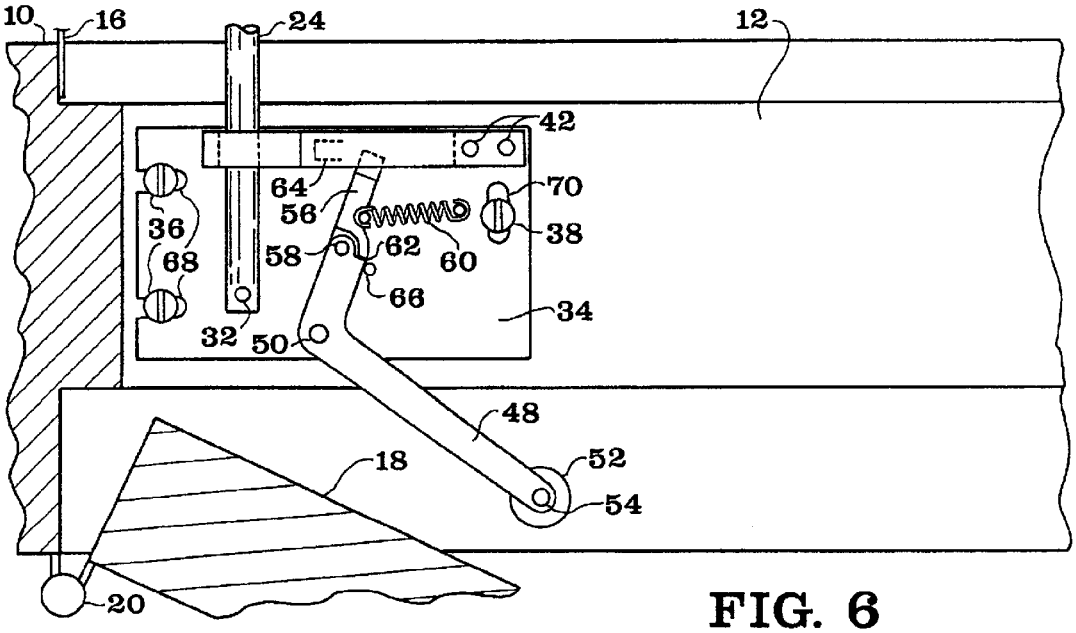
FIG. 6 is a view similar to FIG. 5 but with the inner door opened further.

As the inner door 18 is opened release lever 48 and wedge member 56 rotate as a unit under the influence of spring 60 until the free end of wedge member 56 contacts the vertical portion of ramp 64 which is integral with catch 40. As shown in FIG. 5, upon further movement of inner door 18, the release lever 48 follows but the end of the wedge member 56 is held back by ramp 64. As the inner door 18 continues opening wedge member 56 rotates relative to release lever 48 at pivot point 58 thus effectively shortening the radial distance from pivot 50 to the tip of wedge member 56. When that length becomes shorter than the distance from pivot 50 to the near surface of ramp 64 then the wedge member will no longer be constrained buy ramp 64 and it will rotate clockwise to its stop 62. FIG. 6 shows the position these component s will assume when inner door 18 has opened beyond about 20 degrees; spring 60 pulls wedge member 56 against its stop 62 which pulls release lever 48 against its stop 66.

Figure 7:
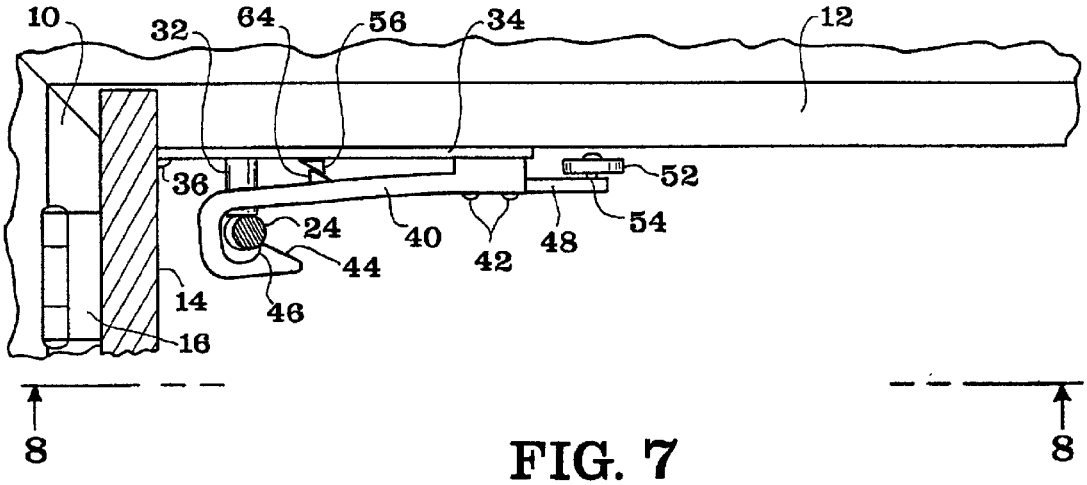
FIG. 7 is a side view similar to FIG. 3 but shown at the point where the outer door is about to be released.
Figure 8:
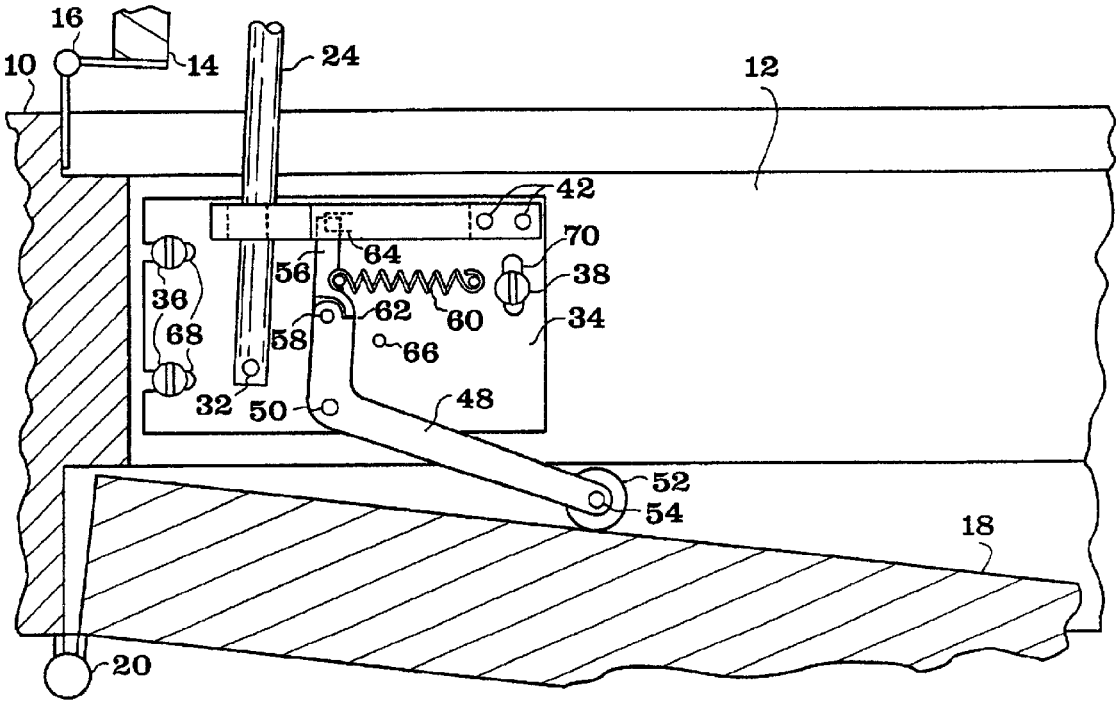
FIG. 8 is an underside sectional view taken along line 8—8 of FIG. 7.

If inner door 18 is now closed wedge member 56 will contact the sloped section of ramp 64 as shown in FIGS. 7 and 8. This contact deflects the free end of catch 40 downward which releases door closer rod 24, which allows the outer door 14 to close under the action of door closer cylinder 22. When the inner door 18 is fully closed the components assume the positions shown in FIGS. 1 and 2.

Typical operation of the system described above is as follows: when entering the building from outside the user opens the outer door 14 to the point where it is held. The user then opens the inner door 18 and walks in. Upon closing the inner door 18 the outer door 14 is released and closes. When exiting the building in the normal situation the user opens the inner door 18 then opens the outer door 14 and walks through. If the inner door 18 is self locking the user may close the inner door 18 and release the outer door 14 once clear. If the inner door 18 needs to be locked from the outside the user may open the outer door 14 to its hold position, lock the inner door 18 and release the outer door 14 with a nudge.

The installation procedure for the invention is as follows: starting with the closer assembly in the configuration shown in FIG. 6 and with the inner door 18 and outer door 14 open the closer assembly is held up to the lintel 12 and slots 68 are marked. Holes are drilled for screws 36 and screws 36 are screwed in most of the way. Housing plate 34 is inserted between the heads of screws 36 and the lintel 12 so that the screws 36 are midway in the slots 68. Screws 36 are tightened if the alignment with outer door 14 is satisfactory a hole for screw 38 is drilled in the lintel 12 within slot 70. Screw 38 is screwed in and tightened. Bracket 28 is affixed to the outer door 14 in a conventional manner. Adjustment to the hold open position of the outer door 14 may be made by loosening screws 36 and screw 38 and repositioning the housing plate 34.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A door hold open and controlled release mechanism, comprising:

a first door and a second door mounted such that while in their respective closed positions the first door is generally parallel to and offset in a direction normal to a front major plane of the second door, the first door being biased toward its closed position;

a first means for holding the first door in an open position against the first door's tendency to move toward the closed position; and a second means for disengaging said first means upon closing of the second door, thereby allowing the first door to move toward its closed position.

2. The mechanism of claim 1 wherein said first means comprises a catch mechanism, said catch mechanism comprising a catch member and a caught member.

3. The mechanism of claim 2 wherein said caught member comprises a rod, said rod being connected to the first door, said rod engaging with said catch member to hold the first door in the open position.

4. A door hold open and controlled release system comprising:

a door arrangement comprising a first door, movable between a first open position and a first closed position, and a second door, movable between a second open position and a second closed position, mounted such that while in their respective closed positions the first door is generally parallel to and offset in a direction normal to a front major plane of the second door, said first door having a biasing device exerting a biasing force against said first door tending to move said first door from said first open position to said first closed position and to maintain said first door in said first closed position;

a catch mechanism connected to said first door, said catch mechanism being designed for holding said first door in said first open position; and a catch release mechanism connected to said catch mechanism, said catch release mechanism causing disengagement of said catch mechanism upon said second door being moved from said second open position toward said second closed position thereby allowing said biasing device to move said first door from said first open position toward said first closed position.

5. The system of claim 4 wherein said catch mechanism comprises a rod and a catch member, said rod being connected to said first door, said rod engaging with said catch member to hold said first door in said first open position.

6. The system of claim 4 wherein said catch release mechanism comprises an activator and a disengaging device, said activator being coupled to said disengaging device in a manner whereby a closing movement of said second door moves said activator thereby causing said disengaging device to prevent said catch mechanism from holding said first door in said first open position and thereby allowing said biasing force to close said first door.

7. The system of claim 4 further comprising a door frame and a housing mounted to said door frame, said catch mechanism and said catch release mechanism being mounted on said housing.

8. The system of claim 7 wherein a location of said first open position is adjustable, by changing a mounted orientation of said housing.

9. A door hold open and controlled release mechanism adapted for usage in conjunction with a door, and a door frame, said mechanism comprising:

a housing adapted to be mounted to the door frame;

a door closer comprising a rod for moving the door toward its closed position;

a catch member connected to said housing, said catch member including a first ramp section, a hold section adjacent to said first ramp section, a second ramp section, and a biasing element for biasing said first ramp section, second ramp section and hold section in a first position, said catch member being adapted to engage the rod of the door closer in a manner whereby said catch member allows free movement of the door as the door is being opened and, once the door has passed a set point, said catch member restrains the door with sufficient force to resist the closing tendency of the door closer; and a catch release mechanism connected to said housing and adapted to move in a first direction and a second opposing direction, said catch release mechanism being biased toward said second direction, wherein said catch release mechanism includes a, wedge portion, said wedge portion being pivoted to said catch release mechanism at a joint and said catch release mechanism including a stop for stopping pivotal movement of said wedge portion relative to said catch release mechanism, and when moved in said first direction, said catch release mechanism causes the wedge portion thereof to engage said second ramp section thereby allowing the door to move to the closed position, and wherein when moved in said second opposing direction, said wedge portion pivots at the joint away from said stop thereby preventing engagement of said wedge portion with said second ramp section.

10. The mechanism of claim 9 wherein the point at which said catch member restrains the door is adjustable by changing the mounted orientation of said housing.

11. A door hold open and controlled release mechanism comprising:

a housing mounted to a door frame;

a door closer, including a rod interconnected between the housing and an outer door and tending to move the outer door toward its closed position;

a catch member connected to said housing and comprising a first ramp section, a hold section adjacent to said first ramp section configured to hold the rod therein, a biasing element connected to said hold section, and a second ramp section connected to said biasing element; and a catch release member including a release lever pivotally attached to said housing and biased towards an inner door, and a wedge member pivotally attached to said release lever and engageable with said second ramp section of the catch member;

wherein as the outer door is opened, the rod contacts said first ramp section causing deflection of said biasing element until the rod is moved into said hold section whereby the outer door is held in an open position; and wherein as the inner door is opened, said release lever moves away from the outer door and said wedge member is moved towards said second ramp section, and as the inner door is closed, said release lever is moved towards the outer door causing said wedge member to engage said second ramp section and deflect said biasing element to release the rod from said hold section and allow the outer door to close.

12. The mechanism of claim 11, wherein said catch release member includes an extension spring that biases said wedge member and release lever.

13. The mechanism of claim 11, including a wheel rotatably attached to an end of said release lever and engageable with the inner door.

14. A door hold open and controlled release mechanism adapted for usage in conjunction with a first door mounted in juxtaposition with a second door, the first door being biased toward a closed position, said mechanism comprising:

a first means for holding the first door in an open position against the first door's tendency to move toward the closed position; and a second means for disengaging said first means upon closing of the second door, thereby allowing the first door to move toward its closed position;

wherein said second means comprises a catch release mechanism, said catch release mechanism comprising an activator coupled to a disengaging device;

wherein said activator comprises a follower, said follower being biased toward the second door and positioned to be in contact with the second door during the closing movement of the second door so that said follower correspondingly moves with the closing movement of the second door.

15. The mechanism of claim 14 wherein said disengaging device causes disengagement of said first means.

* * * * *